US005791958A

United States Patent [19]

Yeung

[11] Patent Number: 5,791,958

[45] Date of Patent: Aug. 11, 1998

[54] STRADDLE-TYPE POOL FLOAT

[75] Inventor: Man Fu E. Yeung, Rowland Heights, Calif.

[73] Assignee: Sunco Products, Inc., Industry, Calif.

[21] Appl. No.: 698,728

[22] Filed: Aug. 16, 1996

[51] Int. Cl.[6] ..... B63C 9/08

[52] U.S. Cl. ..... 441/130

[58] Field of Search ..... 441/129, 130, 441/131, 35, 40, 125, 126

[56] References Cited

U.S. PATENT DOCUMENTS

| | | | |
|---|---|---|---|
| 2,562,080 | 7/1951 | Barnes | 441/131 |
| 3,574,244 | 4/1971 | Huss | 441/131 |
| 4,905,332 | 3/1990 | Wang | 441/130 |
| 5,411,425 | 5/1995 | Rinker | 441/130 |

*Primary Examiner*—Stephen Avila
*Attorney, Agent, or Firm*—Stein, Pendorf & Van Der Wall

[57] ABSTRACT

An inflatable float for use in water by persons to float therein comprising a first and second air chambers each having a top and bottom side, a submerged air chamber interposed between the first and second air chambers forming a saddle capable of being straddled by a person, and a pair of support members connecting the submerged air chamber to the bottom sides of the first and second air chambers. The support members are connected to the bottom side of each of the first and second air chambers such that substantially the entire length of both bottom sides remain in floating contact with the surface of the water. The first and second air chambers may be shaped to form the head and tail of an animal.

18 Claims, 3 Drawing Sheets

STRADDLE-TYPE POOL FLOAT

BACKGROUND OF THE INVENTION

1. Field of the Invention

The present invention relates to a float used in water and, more particularly, to an inflatable float to be straddled by a person while in water.

2. Description of the Background Art

Presently, most commercially available water floats are well known and are in wide use today throughout the water-related industry. Many of the known floats are inflatable and are designed to be placed around the waist or both upper arms of the swimmer. These types of floats are dependant upon the swimmers ability to remain within the circumference of the float. Often, a swimmer may slide through the float and into the water or the swimmer's arms may slip out of the their floats. Also, the use of these floats are often dependant upon their diameter as well as the size of the swimmer. Most currently available water floats are not suitable for the diversity in shapes and sizes of most swimmers.

Moreover, common life vests that position around a swimmer's neck and then rest upon the swimmer's shoulders are well known. However, these life vests only keep the swimmer's head above water and require that the life vest be secured around the waist. This limits the visibility of the swimmer as well as restricts the swimmer's movements.

Consequently, the swimmer's ability to remain within the float and the float's restrictive nature are key features in the design of water floats. In response to the realized inadequacies of these earlier water floats, it became clear that there is a need for a straddle-type water float that may be used by swimmers or bathers with many different body sizes. Currently available straddle-type floats comprise of two air chambers joined by a non-inflatable member in the center. However, these straddle-type floats are not well suited for use by a swimmer for long periods of time. These known straddle-type floats do not have an inflatable seat and, therefore, fail to continuously provide a stable means for a swimmer to straddle because the seat becomes folded between the swimmer's legs.

A new device must also provide a means for floating a swimmer while maintaining the swimmer's visibility and movement. In as much as the art consists of various types of water floats, it can be appreciated that there is a continuing need for and interest in improvements to water floats, and in this respect, the present invention addresses these needs and interests.

Therefore, the principal object of this invention is to provide an improvement which overcomes the aforementioned inadequacies of the prior art devices and provides an improvement which is a significant contribution to the advancement of the inflatable float art.

Another object of this invention is to provide a new and improved water float which has all the advantages and none of the disadvantages of the earlier water floats.

Still another objective of the present invention is to provide an inflatable float that incorporates an inflatable saddle such that the person straddles the seat and, therefore, may rest and recline.

Another objective is to provide an inflatable float that incorporates an inflatable saddle that is substantially spread apart between the swimmer's legs.

Yet another objective of the present invention is to provide an inflatable float that is lightweight and easily transported to other locations for use after deflating and folding up thereof.

Still a further objective of the present invention is to provide an inflatable float where one size of float fits all swimmers and keeps them afloat.

Yet a further objective is to provide an inflatable float that is more stable and allows the swimmer or bather to use less energy to keep afloat.

An additional objective is to provide an inflatable float that maintains the swimmer's head and shoulder's above the water.

Another objective is to provide an inflatable float that is easily manufactured and assembled.

Even yet another objective is to provide an inflatable float that allows for greater movement by the swimmer while in the water.

Still yet another objective is to provide an inflatable float where substantially the entire bottom surface of the float remains in contact with the surface of the water.

A further objective is to provide an inflatable float for use in water by persons to float therein, the inflatable float comprising: a first and second means for flotation each having a top side and a bottom side; a submerged air chamber interposed between said first and second means for flotation and forming a saddle to be straddled by a person's legs, said saddle supporting the person when the person is seated within; and means for coupling said submerged air chamber to said first and second means for inflation, said means for coupling suspending said saddle in the water.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies the need for a straddle-type water float that may be used by swimmers or bathers with many different body sizes. This device must also provide a means for floating a swimmer while maintaining the swimmer's visibility and movement. For the purpose of summarizing the invention, the invention comprises a first and second means for flotation each having a top and bottom side. Also, a submerged air chamber is interposed between the first and second means for floatation. This submerged air chamber is to form a saddle which is to be straddled by a person's legs. The saddle supports the swimmer or bather when the person is straddling the saddle while in the water. A means for coupling the submerged air chamber to the first and second means for flotation suspends the saddle in the water.

In one embodiment, the first and second means for flotation form substantially the shape of an animal. For example, the first means for flotation forms a portion of an animal and the second means for flotation forms another portion of an animal. More particularly, the first means for flotation forms an alligator head and the second means for flotation forms an alligator tail.

In one embodiment, the saddle of the present invention is substantially hourglass-shaped and comprises a center air chamber positioned substantially in the center of the submerged air chamber and a transverse pair of substantially crescent-shaped air chambers on opposite sides of the center air chamber. The center air chamber and transverse pair of crescent-shaped air chambers expand the saddle such that the saddle is spread apart between the person's legs. Also, the transverse pair of substantially crescent-shaped air chambers may extend onto the support members. During use, this saddle provides a stable seat for a swimmer and keeps the swimmer afloat. The swimmer straddles the submerged air chamber such that the saddle holds the person's shoulder's and head up and out of the water. The swimmer may then rest and recline or preserve energy otherwise utilized to keep afloat. Moreover, a straddle-type float allows the swimmer to be free of any other restraints or restriction upon the upper body. This allows the swimmer or bather to have freer movement and to float more comfortably.

Alternatively, the saddle of the present invention is substantially hourglass-shaped and comprises a center air chamber positioned substantially in the center of the submerged air chamber and a longitudinal pair of end air chambers on opposite ends of the center air chamber. The center air chamber and the longitudinal pair of end air chambers expand the saddle such that the saddle is spread apart between the person's legs. This embodiment holds the swimmer up and out of the water while providing a stable seat for the swimmer to relax or rest in.

In another embodiment, the means for coupling of the present invention comprises a pair of support members that have a first end and a second end. The first end of one of the support members is integrally connected to the first means for flotation and the first end of the other support member is integrally connected to the second means for flotation. Then, the second end of both support members is integrally connected to the submerged air chamber. One advantage this embodiment is its simple construction and relative ease in manufacturing.

In another embodiment, the first and second means for flotation both have a circumferential edge. The means for coupling comprises a pair of support members where each have a first and second end. The second end of both support members is integrally connected to the submerged air chamber. One of the first ends of the pair of support members is connected to the first means for flotation. The other first end of the pair of support members is also connected to the second means for flotation. The first and second means for flotation are connected at a distance away from the circumferential edge of each means for flotation such that substantially the entire length of the bottom sides of the first and second means for flotation remain in floating contact with the water.

In another version, the first and second means for flotation of the present invention further comprises rope eyelets attached to the bottom side of each means for flotation. Rope then attaches both means for flotation to the means for coupling by placing the rope through the rope eyelets attached to the bottom sides. In another embodiment of the invention, the means for coupling further comprises at least one hole positioned so as to facilitate free flow of water between the swimmer and the inflatable float. Also, in an alternative embodiment, at least one of the means for flotation includes at least one hand hold so that a swimmer may grasp the inflatable float during use in the water.

Alternatively, the first and second means for flotation are first and second air chambers that are inflatable. The first and second air chambers as well as the submerged air chamber each may be in direct fluid communication with a valve means for selective inflation and deflation. Some of the advantages of any one of these embodiments, or any in combination, are that the inflatable float is lightweight and may be easily transported to other location for use after deflating and folding up and that may be straddled by a swimmer while in the water so that the swimmer may rest and conserve energy. Also, these embodiments have other advantages as previously identified.

An important feature of the present invention is that the inflatable float maintains the swimmer's head and shoulders above the water in a stable manner and that the swimmer can not slip through the float. Another feature of some of the embodiments of the present invention is that while the swimmer is straddling the inflatable float, that both bottom sides of the first and second means for flotation remain entirely in floating contact with the surface of the water. Therefore, it can be readily seen that the present invention provides a means to sit on a water float in a straddled position in a stable manner while in the water. Thus, a straddle-type inflatable float would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1:
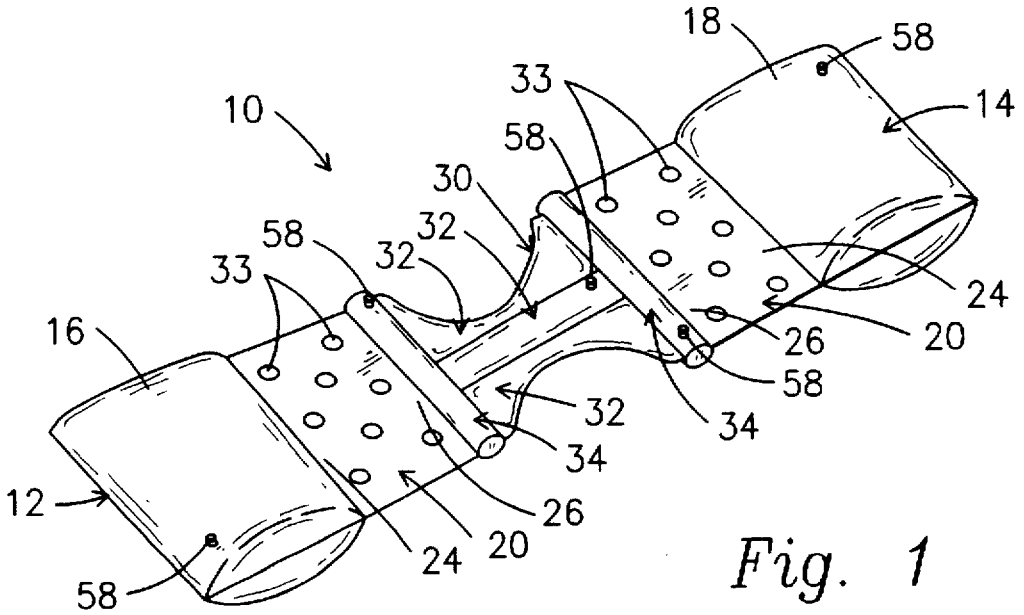
FIG. 1 is a perspective view of the inflatable float according to the first preferred embodiment of the present invention illustrating the first and second air chambers connected by a pair of support members to the submerged air chamber interposed therebetween.
Figure 4:
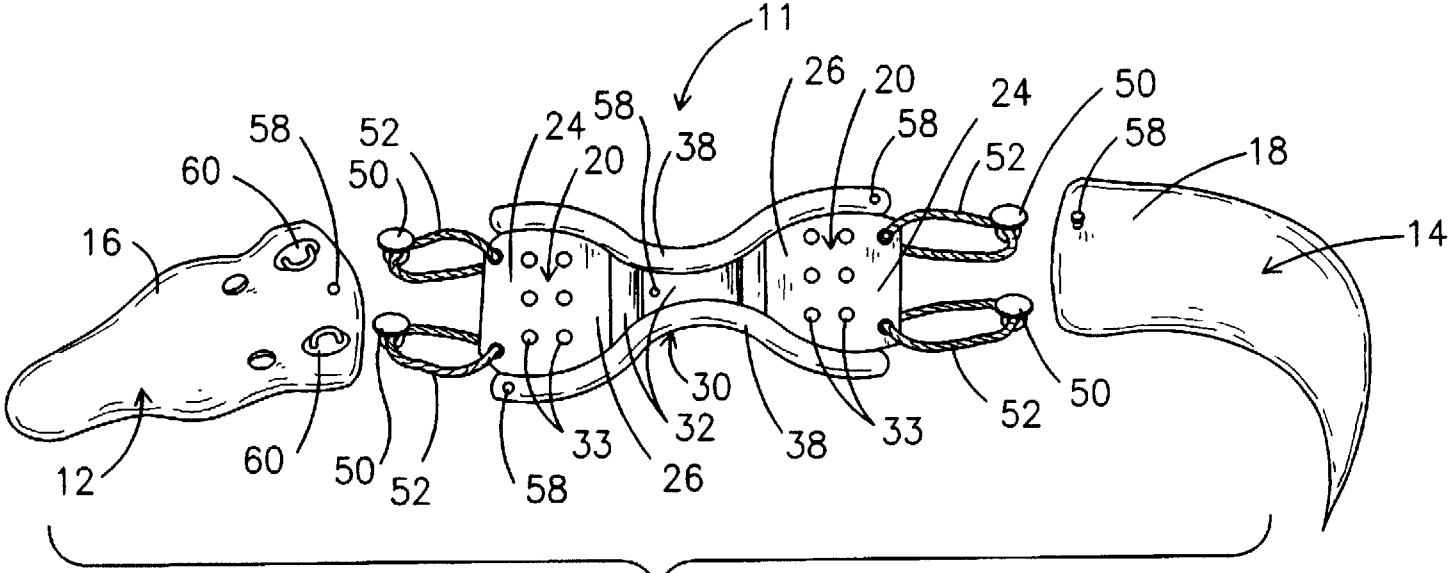
FIG. 4 is a an exploded top plan view of the inflatable float in the second preferred embodiment of the present invention illustrating the inflatable float in the form of an alligator.

With reference to the drawings, and in particular to FIG. 1 and FIG. 4 thereof, a new and improved inflatable float embodying the principles and concepts of the present invention and generally designated by the reference numerals 10 and 11 will be described. As shown in FIG. 1, the inflatable float 10 comprises a first means for flotation 12 and a second means for flotation 14. Interposed between the first and second means for flotation 12 and 14 is a submerged air chamber 30 forming a saddle 30. The submerged air chamber 30 is coupled to the first and second means for flotation 12 and 14 by a means for coupling 20. The submerged air chamber 30 may be in direct fluid communication with a valve means 58 for selective inflation and deflation thereof.

In one version of the present invention, the first and second means for inflation 12 and 14 form substantially the shape of an animal. More particularly, the first means for inflation 12 forms substantially a portion of an animal and the second means for floatation forms substantially another portion of an animal. For example, the first means for floatation 12 may be shaped substantially in the form of an alligator head and the second means for flotation may be shaped substantially in the form of an alligator tail.

In another version of the present invention, the saddle 30 is substantially hourglass-shaped and comprises a center air chamber 32 and a transverse pair of substantially crescent-shaped air chambers 38 on opposite sides of the center air chamber 32. The center air chamber 32 and transverse pair of substantially crescent-shaped air chambers 38 expand the saddle 30 so that the saddle 30 is spread apart between a swimmer's legs. Also, in a similar embodiment, the transverse pair of substantially crescent-shaped air chambers 38 extend onto the coupling means 20 to provide additional stability. This particular configuration of the saddle 30 is illustrated in FIG. 4 of the inflatable float 11.

Figure 3:
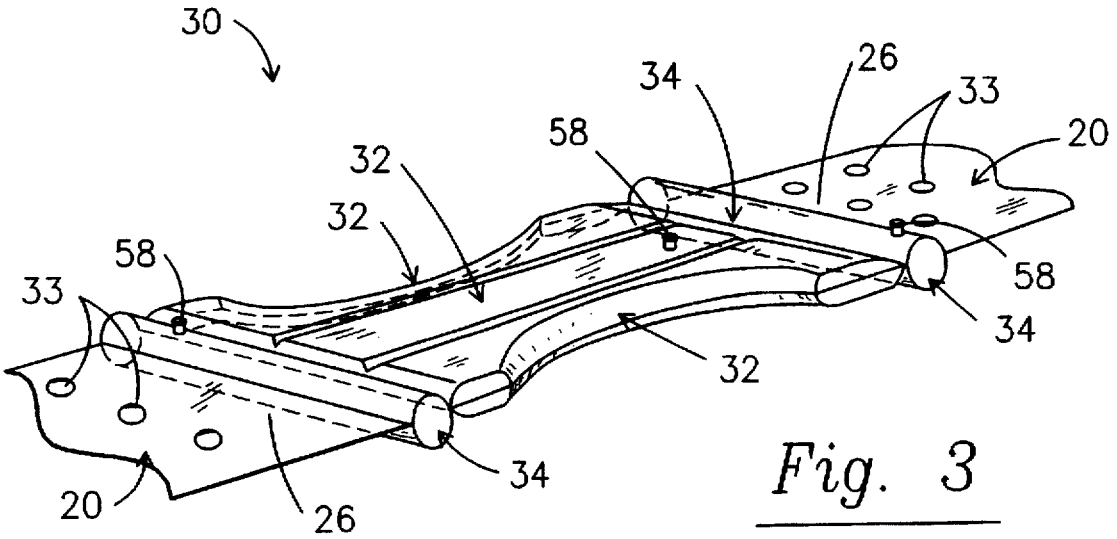
FIG. 3 is a partial perspective view of the inflatable float of FIG. 1 illustrating the submerged air chamber.

In an alternative version, the saddle 30 is substantially hourglass-shaped and comprises a center air chamber 32 positioned substantially in the center of the submerged air chamber 30 and a longitudinal pair of end air chambers 34. The longitudinal pair of end air chambers 34 are on opposite ends of the center air chamber 32. The center air chamber 32 and the longitudinal pair of end chambers 34 expand the saddle 30 so that the saddle 30 is spread apart between a swimmer's legs. This particular configuration of the saddle is illustrated in FIG. 3.

In another version of the present invention, the means for coupling 20 comprises a pair of support members 20 each having a first end 24 and a second end 26. The first end 24 of one of the pair of support members 20 is integrally connected to the first means for flotation 12 and the first end 24 of the other of the pair of support members 20 is integrally connected to the second means for flotation 14. The second end 26 of each of the pair of support members 20 is also integrally connected to the submerged air chamber 30. One of the many advantages of this version of the invention is that this version is easily manufactured and easily assembled.

Also, in another version, the first and second means for floatation 12 and 14 each include a circumferential edge 19. The means for coupling 20 comprises a pair of support members 20 each having a first end 24 and a second end 26. Both of the second ends 26 are integrally connected to the submerged air chamber 30. One of the first ends 24 of one of the pair of support members 20 is connected to the first means for floatation 12 and the other first end 24 of the pair of support members 20 is connected to the second means for floatation 14. Both first and second means for floatation 12 and 14 are connected at a distance away from the circumfrential edge 19 of each of the first and second means for floatation 12 and 14 such that the entire length of the bottom sides 15 and 17 remain in floating contact with the water.

Figure 5:
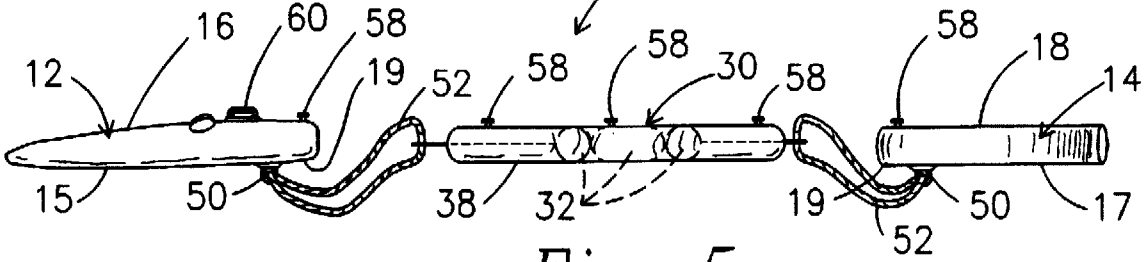
FIG. 5 is a side elevation view of the inflatable float in the second preferred embodiment of the present invention illustrating the first and second air chambers connected by a pair of support members to the submerged air chamber interposed therebetween.
Figure 6:
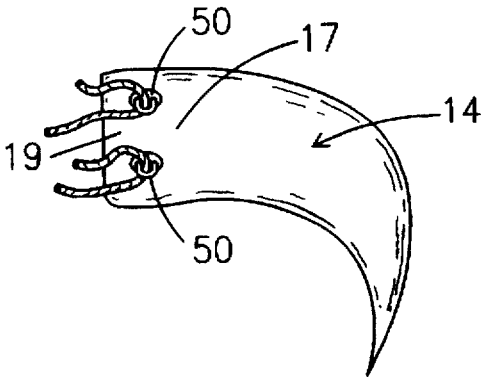
FIG. 6 is a bottom view of the second air chamber of the second preferred embodiment illustrating the positioning of the pair of rope eyelets at a distance away from the circumferential edge.
Figure 7:
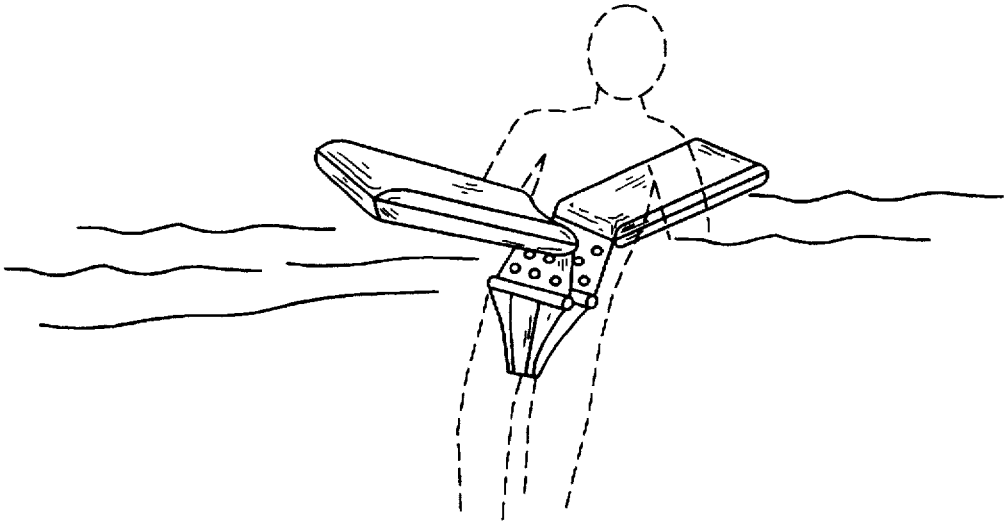
FIG. 7 is a perspective view of the inflatable float of FIG. 1 in the water and in phantom.

This provides a more stable float than if the floatation means 12 and 14 were connected on the ends of each which would put substantally all of the weight of the swimmer on the ends of the flotation means and, thus, cause one of the ends of the flotation means to be pulled underneath the surface of the water and the opposite end of the same flotation means to be raised into the air. One feature of the present invention, is that the weight of the swimmer is spread out over the length of the first and second means for flotation 12 and 14 and, therefore, provides a more stable inflatable float 11. In a variation of this latest version, as shown in FIGS. 4, 5, and 6, a pair of rope eyelets 50 are attached to the bottom sides 15 and 17. A length of rope 52 is then threaded through each pair of rope eyelets 50 to connect the pair of support members 20 to the first and second means for floatation 12 and 14.

In another version of the present invention, the means for coupling 20 has at least one hole 33 positioned so as to facilitate the free flow of water between the swimmer and the means for coupling 20. Also, at least one of the means for floatation may include a hand hold 60 for the swimmer to grasp while straddling the inflatable float 11 while in the water as shown in FIGS. 4 and 5.

In one version of the present invention, the first and second means for flotation 12 and 14 are first and second air chambers 12 and 14. The first and second air chambers 12 and 14 may be in direct communication with a valve means 58 for selective inflation and deflation.

Figure 2:
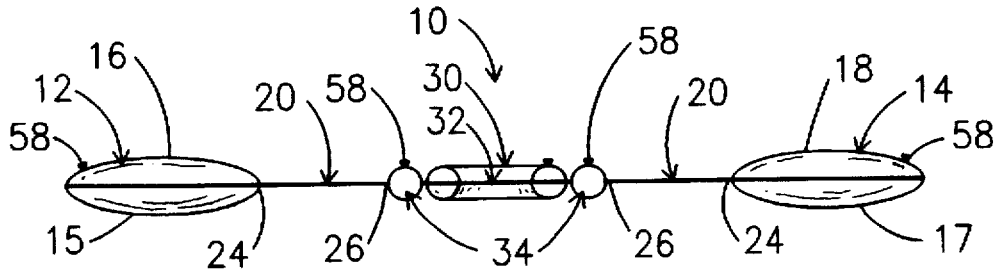
FIG. 2 is a side elevation view of the inflatable float according to the first preferred embodiment of the present invention.

In the first preferred embodiment as shown in FIGS. 1, 2, and 3, the first and second means for flotation 12 and 14 comprises of first and second air chambers 12 and 14. The first air chamber 12 has a top side 16 and a bottom side 15. The second air chamber 14 has a top side 18 and a bottom side 17. The first embodiment, as shown in detail in FIG. 3, further comprises of the submerged air chamber 30 forming a saddle 30 that is substantailly hourglass-shaped and comprises a center air chamber 32 positioned substantially in the center of the submerged air chamber 30 and a longitudinal pair of end air chambers 34. The longitudinal pair of end air chambers 34 are on opposite ends of the center air chamber 32. As illustrated in FIG. 3, the center air chamber 32 may comprise of a pluality of segmented air chambers capable of being inflated to make up the center air chamber 32 itself as well as the form of the saddle 30.

The coupling means in the first preferred embodiment of the present invention comprises of first and second support members 20 each having a first end 24 and a second end 26. As seen in FIGS. 1 and 2, the first end 24 of one of the pair of support members 20 is intregally connected to the first air chamber 12 and the first end 24 of the other support member 20 is intregally connected to the second air chamber 14. The second end 26 of both of the pair of support members 20 is intregally connected to the submerged air chamber 30.

In the first preferred embodiment, each of the pair of support members 20 has a plurality of holes 33 through each of the pair of support members 20. Also, in the first preferred embodiment the first and second air chambers 12 and 14, as well as the submerged air chamber 30, each are in direct fluid communication with a valve means 58 for selective inflation and deflation thereof.

While a person is straddling the inflatable float 10, where one of the person's legs is positioned on opposite sides of the submerged air chamber 30, the center air chamber 32 and the longitudinal pair of end air chambers 34 expand the saddle 30 between the person's legs. The saddle 30 supports the person while the person is in the water and seated upon the inflatable float 10.

In the second preferred embodiment of the present invention of the inflatable float 11, as shown in FIGS. 4, 5, and 6, the present invention comprises of the first and second air chambers 12 and 14, the submerged air chamber 30, and the pair of support members 20. The first air chamber 12 substantially forms an alligator head and the second air chamber 14 substantially forms an alligator tail. The first air chamber 12 includes two hand holds 60 in order for a swimmer to grasp the inflatable float 11 while in the water. The first air chamber 12 has a bottom side 15 and a top side 16. The second air chamber 14 has a bottom side 17 and a top side 18. Also, each of the first and second air chambers 12 and 14 have a circumferential edge 19 on each said bottom side 15 and 16. Each bottom side 15 and 17 further include a pair of rope eyelets 50 attached to each bottom side 15 and 17.

The submerged air chamber 30 of the second preferred embodiment forms an hourglass-shaped saddle 30 to be straddled by a person's legs and comprises a center air chamber 32 positioned substantially in the center of the submerged air chamber 30 and a transverse pair of substantially crescent-shaped air chambers 38 on opposite sides of the center air chamber 32. The transverse pair of substantially crescent-shaped air chambers 38 extend on to the pair of support members 20. As illustrated in FIG. 4, the center air chamber 32 may comprise of a plurality of segmented air chambers capable of being inflated to make up the center air chamber 32 itself as well as the form of the saddle 30. The center air chamber 32 and the transverse pair of crescent-shaped air chambers 38 expand the saddle 30 between the swimmer's legs so that the stability of the inflatable float 11 is maintained.

The second end 26 of the pair of support members 20 are integrally connected to the submerged air chamber 30. The first end 24 of one of the pair of support members 20 is connected by rope 52 to the first air chamber 12. A length of rope 52 is threaded through each pair of rope eyelets 50 on the bottom side 15. Each length of rope 52 is then treaded through an eyelet on the first end 24 of one of the pair of support members 20. The first end 24 of the other of the pair of support members 20 is also connected by rope 52 to the second air chamber 14. A length of rope 52 is threaded through each pair of rope eyelets 50 on the bottom side 17. Each length of rope 52 is then threaded through an eyelet on the first end of the other of the pair of support members 20.

An important feature of the second preferred embodiment of the present invention is that the pair of rope eyelets 50 are positioned upon the each of the bottom sides 15 and 17 at a distance away from the circumferential edge 19 on each bottom side 15 and 17 so that substantially the entire length of the bottom sides 15 and 17 remain in floating contact with the water. This configuration is illustrated in FIG. 6. Thus, the saddle 30 is suspended between the first and second air chambers 12 and 14 and supports the person while the person is seated upon the inflatable float 11 in the water. Therefore, more of the first and second air chambers 12 and 14 remains in contact with the surface of the water and provides a more stable inflatable float 11 for a swimmer to rest upon.

The previously described embodiments of the present invention have many advantages including eliminating any restrictions upon the upper body in order to use the inflatable float 10 or 11 as well as maintaining the swimmer's head and shoulders above the surface of the water such that the swimmer has increased movement and visibility.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. An inflatable float for use in water by persons to float therein, said inflatable float comprising:

a first and second means for flotation each having a top side and a bottom side;

a submerged air chamber interposed between said first and second means for flotation forming a buoyant saddle to be straddled by a person's legs, said saddle supporting the person and recovering size and form between the person's legs when the person is seated within, said saddle comprising a center air chamber positioned substantially in the center of said submerged air chamber and a transverse air chamber on each side of said center air chamber respectively, said center air chamber and both said transverse air chambers expanding said saddle such that said saddle is substantially spread apart between the person's legs; and means for flexibly coupling said submerged air chamber to said first and second means for inflation, said means for flexibly coupling suspending said saddle in the water.

2. The inflatable float as claimed in claim 1, wherein said first and second means for flotation form substantially the shape of an animal.

3. The inflatable float as claimed in claim 1, wherein said first means for flotation forms substantially a portion of an animal and said second means for flotation forms substantially another portion of an animal.

4. The inflatable float as claimed in claim 1, wherein said first means for flotation is shaped substantially in the form of an alligator head and said second means for flotation is shaped substantially in the form of an alligator tail.

5. The inflatable float as claimed in claim 1, wherein said means for flexibly coupling comprises a pair of support members each having a first and second end, said first end of one of said support members integrally connected to said first means for flotation, said first end of the other said support member integrally connected to said second means for flotation, and each second end of said pair of support members integrally connected to said submerged air chamber.

6. The inflatable float as claimed in claim 1, wherein said first and second means for flotation each have a circumferential edge on each said bottom side, and said means for flexibly coupling comprises a pair of support members each having a first and second end, each second end of said pair of support members integrally connected to said submerged air chamber, and one of said first ends of said pair of support members connected to said first means for flotation and the other of said first ends of said pair of support members connected to said second means for flotation, said first and second means for flotation connected at a distance away from said circumferential edge of each of said first and second means for flotation such that substantially the entire length of said bottom side of each of said first and second means for flotation remains in floating contact with the water.

7. The inflatable float as claimed in claim 1, wherein said means for flexibly coupling further comprises at least one hole positioned so as to facilitate free flow of water.

8. The inflatable float as claimed in claim 1, wherein at least one of the means for flotation includes at least one hand hold.

9. The inflatable float as claimed in claim 1, wherein said first and second means for flotation are first and second air chambers.

10. The inflatable float as claimed in claim 1, wherein said submerged air chamber is in direct fluid communication with a valve means for selective inflation and deflation thereof.

11. The inflatable float as claimed in claim 1, wherein said transverse air chambers extend onto said means for flexibly coupling.

12. The inflatable float as claimed in claim 1, wherein a pair of rope eyelets are attached to said bottom sides of said first and second means for flotation and rope is threaded through said pair of rope eyelets to connect said pair of support members to said first and second means for flotation.

13. The inflatable float as claimed in claim 9, wherein said first and second air chambers are in direct fluid communication with a valve means for selective inflation and deflation thereof.

14. The inflatable float as claimed in claim 1 wherein said saddle is substantially hourglass-shaped and said transverse air chambers are crescent-shaped.

15. An inflatable float for use in water by persons to float therein, said inflatable float comprising:

a first and second air chamber each having a top and bottom side, a circumferential edge on each said bottom side, and a pair of rope eyelets attached to each said bottom side, said first air chamber shaped substantially to form one portion of an animal and said second air chamber shaped substantially to form another portion of an animal;

a submerged air chamber interposed between said first and second means for flotation and forming a saddle to be straddled by a person's legs, said saddle supporting the person when the person is seated within, said saddle is substantially hourglass-shaped and comprises a center air chamber positioned substantially in the center of said submerged air chamber, and a transverse pair of substantially crescent-shaped air chambers on opposite sides of said center air chamber, said transverse pair of crescent-shaped air chambers extend onto said pair of support members, said center air chamber and transverse pair of crescent-shaped air chambers expanding said saddle such that said saddle is substantially spread apart between the person's legs; and a pair of support members each having a first and second end, each second end of said support members integrally connected to said submerged air chamber, and one of said first ends of said support members connected by rope to said first air chamber through each of said pair of said eyelets and the other of said first ends of said support members connected by rope to said second air chamber through each of said pair of said eyelets, said pair of rope eyelets on each of said first and second air chambers at a distance away from said circumferential edge of each of said first and second air chamber such that substantially the entire length of said bottom side of each of said first and second air chamber remains in floating contact with the water, and said saddle is suspended between said first and second air chamber and is supporting the person when the person is seated within.

16. An inflatable float for use in water by persons to float therein, said inflatable float comprising:

a first and second air chamber each having a top and bottom side;

a submerged air chamber interposed between said first and second air chambers and forming a saddle to be straddled by a person's legs, said saddle supporting the person when the person is seated within, said saddle is substantially hourglass-shaped and comprises a center air chamber positioned substantially in the center of said submerged air chamber, and a longitudinal pair of end air chambers on opposite ends of said center air chamber, said center air chamber and said longitudinal pair of end air chambers expanding said saddle such that said saddle is substantially spread apart between the person's legs; and a pair of support members each having a first and second end, said first end of one of said support members integrally connected to said first air chamber, said first end of the other said support member integrally connected to said second air chamber, and each second end of said support members integrally connected to said submerged air chamber.

17. An inflatable float for use in water by persons to float therein, said inflatable float comprising:

a first and second means for flotation each having a top side and a bottom side;

a submerged air chamber interposed between said first and second means for flotation forming a buoyant saddle to be straddled by a person's legs, said saddle supporting the person and recovering size and form between the person's legs when the person is seated within, said saddle comprising a center air chamber positioned substantially in the center of said submerged air chamber and longitudinal air chambers on each end of said center air chamber respectively, and said center air chamber and both longitudinal air chamber expanding said saddle such that said saddle is substantially spread apart between the person's legs; and means for flexibly coupling said submerged air chamber to said first and second means for inflation, said means for flexibly coupling suspending said saddle in the water.

18. The inflatable float as claimed in claim 17 wherein said saddle is substantially hourglass-shaped.

* * * * *